United States Patent [19]

Kopf

[11] Patent Number: 4,493,376

[45] Date of Patent: Jan. 15, 1985

[54] FASTENER DRIVING TOOL

[75] Inventor: Rowland J. Kopf, Southington, Conn.

[73] Assignee: Uniset Corporation, Indianapolis, Ind.

[21] Appl. No.: 394,684

[22] Filed: Jul. 2, 1982

[51] Int. Cl.[3] ..... B25D 9/11

[52] U.S. Cl. ..... 173/139; 173/134; 227/9

[58] Field of Search ..... 173/134, 90, 139; 227/9, 10, 11

[56] References Cited

U.S. PATENT DOCUMENTS

| | | | |
|---|---|---|---|
| 4,189,081 | 2/1980 | Combette et al. | 60/635 |
| 4,332,340 | 6/1982 | Harris | 227/9 |
| 4,374,567 | 2/1983 | Combette et al. | 227/9 |

*Primary Examiner*—Donald R. Schran
*Assistant Examiner*—James Wolfe
*Attorney, Agent, or Firm*—William W. Jones

[57] ABSTRACT

This improved powder-actuated fastener driving tool includes a fastener-driving piston which is slidably housed in a reciprocating barrel. The barrel is contained in a housing member. The tool includes a movable firing pin slidably disposed in a movable breech member. A firing pin pawl is retained in a slot in the breech member to hold the firing pin in a cocked position. The firing pin is held in place in the breech member by a removable C ring disposed in a groove in the firing pin spring guide. Auxiliary gas-venting passages are disposed in the housing tool barrel adjacent a piston pawl return slot formed in the barrel. The tool includes a tapered muzzle bushing which reduces the possibility of air-firing the tool. The inner or breech end of the muzzle bushing is spaced from the muzzle end of the barrel to minimize the possibility of deformation of the muzzle bushing due to piston overdrive. The piston return pawl is biased into a tapered counter bore in the piston pawl return slot so as to hold the barrel against accidental movement to its breech-open position.

1 Claim, 8 Drawing Figures

FASTENER DRIVING TOOL

This invention relates to an improved piston-type powder-actuated fastener driving tool. The tool is of simplified construction and includes an improved firing pin assembly, and barrel-muzzle bushing assembly.

Powder-actuated tools are known which include a piston movably mounted in a reciprocating barrel for driving a fastener such as a nail, stud, or anchor into a supporting surface. The tool is typically actuated with a blank cartridge which, when fired, drives the piston from a breechward driving position to a muzzleward driven position. The barrel is reciprocally mounted in a housing and is movable in the housing between a breechward firing position and a muzzleward cartridge ejecting position. A piston return pawl is mounted on the housing and projects into a return slot so as to engage the head of the piston when the latter is in its driven position. Movement of the barrel to its ejecting position causes the piston to be returned to its driving position by reason of engagement between the pawl and piston head. Typically, tools of this type cannot be fired unless the muzzle of the tool is pushed against the supporting surface into which the fastener is to be driven. Combustion gases generated by firing the cartridge drive the piston to set the fastener into the supporting surface.

While such tools, as described generally above, are relatively common, the various functioning mechanisms, such as the firing pin mechanisms, the gas venting systems, the barrel retention mechanisms, and the anti-airfire mechanisms are generally relatively complicated and contribute significant manufacturing expense and complexity to the various prior art tools.

The tool of this invention includes the several operating necessities and advantages noted above while attaining these features with minimum complexity. The tool of this invention includes a simplified firing pin mechanism which is housed in a movable breech block wherein the firing pin is automatically releasably locked in its firing position inside the breech block when the tool is opened to extract a spent cartridge. The breech block and firing pin assembly are held in place in the tool housing by means of a C ring fitted into a groove formed in a projecting spring guide disposed on the back portion of the firing pin. Removal of the C ring allows disassembly of the firing pin and breech block from the tool housing. The combustion gases are vented from the barrel bore through the pawl return slot formed in the barrel and through auxiliary vent ports formed in the barrel adjacent to the pawl return slot. The piston return pawl is mounted in the tool housing and biased by a spring toward the barrel bore. The pawl projects through the pawl return slot to engage the piston head and return the piston to its firing position upon movement of the barrel to its breech-open cartridge-ejecting position. The muzzleward end of the pawl return slot is formed with a tapered counterbore into which the return pawl is biased when the barrel is in its breech closed position. Thus, the barrel is prevented from accidentally moving muzzleward out of the breech closed position as the operator handles the tool. After firing, however, the barrel can easily be intentionally moved muzzleward to return the piston to its firing position. A fastener-retaining muzzle bushing is threaded into the muzzle end of the barrel and projects therefrom. The muzzle bushing is formed with an exterior circumferential flange which abuts the muzzleward end of the barrel. The flange prevents the breechward end of the muzzle bushing from contacting the breechward end of the threaded bore into which the muzzle bushingis screwed. Thus, the mating threads on the barrel and muzzle bushing are protected against deformation which may otherwise occur from piston overdrive. In this manner, the muzzle bushing may be easily unscrewed from the barrel at any time. The muzzle bushing is also rearwardly and inwardly tapered so as to make it difficult for one to grasp the muzzle bushing circumferentially and pull it rearwardly to attempt to air fire the tool.

It is, therefore, an object of this invention to provide an improved simplified powder-actuated piston type fastener driving tool.

It is an additional object of this invention to provide a tool of the character described having a simplified firing pin mechanism.

It is another object of this invention to provide a tool of the character described having improved combustion gas venting capabilities.

It is a further object of this invention to provide a tool of the character described having a simplified barrel detentmechanism for retaining the barrel in a breech-closed position during handling of the tool while allowing easy intentional movement of the barrel to a breech-open position to extract a fired cartridge and load a fresh cartridge.

It is yet another object of this invention to provide a tool of the character described having an improved muzzle bushing mechanism.

These and other objects and advantages of the tool of this invention will become more readily apparent from the following detailed description of a preferred embodiment of the tool taken in conjunction with the accompanying drawings, in which.

Figure 1:
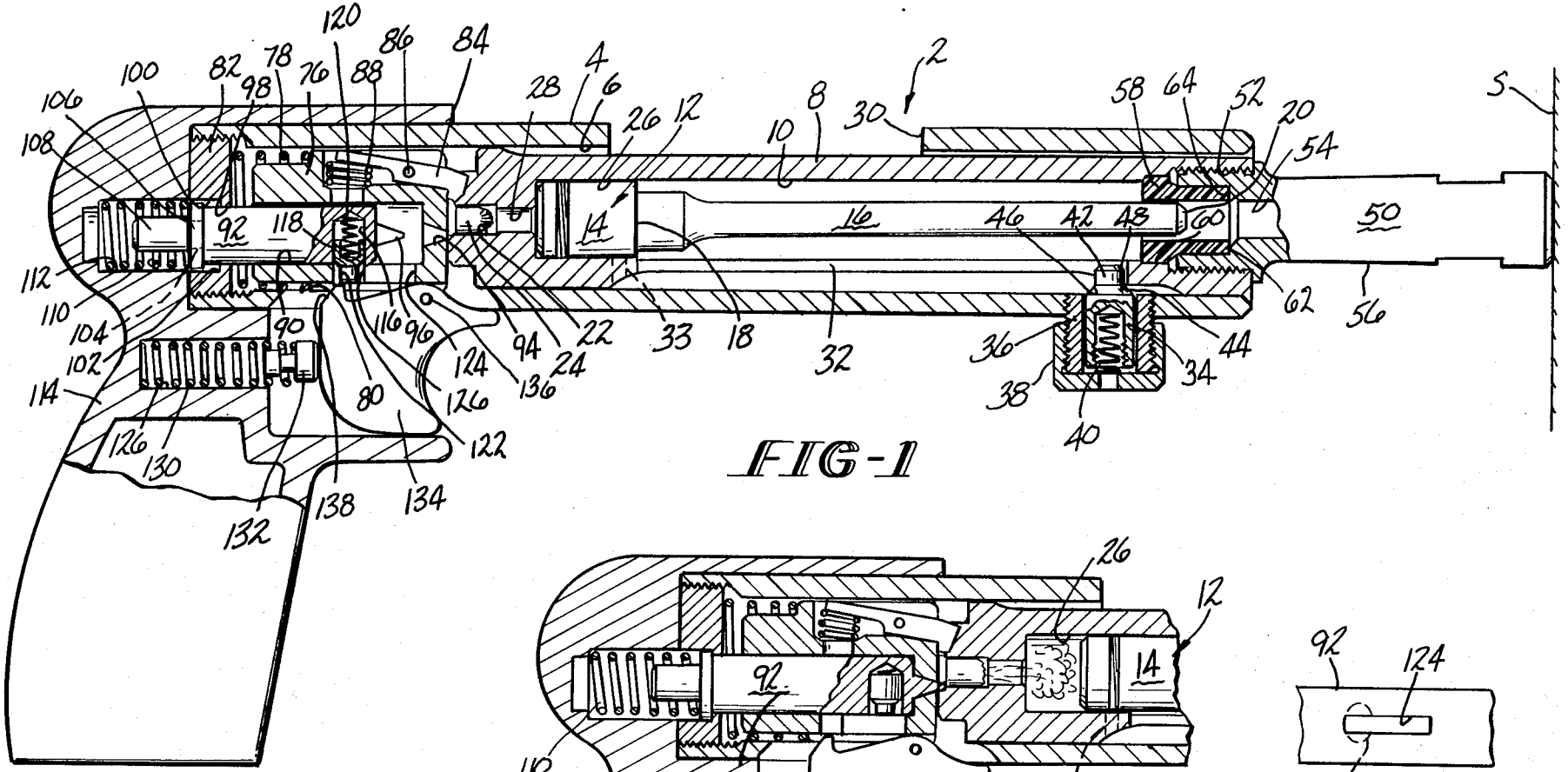
FIG. 1 is an axial sectional view of a preferred embodiment of a tool formed in accordance with this invention, the tool being shown in a cocked, ready to fire condition.

Referring now to the drawings, there is shown in FIG. 1 a preferred embodiment of a powder actuated tool, denoted generally by the numeral 2, formed in accordance with this invention. The tool 2 includes a housing member 4 having a bore 6 in which there is slidably disposed a barrel member 8 which is also provided with a bore 10. A fastener-driving piston 12 is reciprocally slidably disposed in the barrel bore 10. The piston 12 has a head portion 14 and a stem portion 16. A radial shoulder 18 is disposed at the muzzleward end of the piston heat 14, and the muzzleward end 20 of the piston stem 16 is the fastener-driving surface of the piston 12. The breechward end of the barrel 8 is provided with a firing chamber 22 in which is seated a blank cartridge 24, the firing of which provides power for driving the piston 12 from its driving position shown in FIG. 1 to a muzzleward driven position. The firing chamber 22 communicates with a gas expansion portion 26 of the barrel bore 10 via a passage 28. When in the driving position, the head 14 of the piston 12 is disposed in the gas expansion portion 26 of the barrel bore 10, as shown in FIG. 1. The barrel 8 is slidably disposed in the housing bore 6 for movement between a breech-closed position shown in FIG. 1 and a muzzleward breech-open position for extraction and loading of cartridges. An opening 30 is formed in the housing 4 for removal of extracted cartridges and for insertion of fresh cartridges into the firing chamber 28 when the barrel 8 is in its breech-open position. The barrel 8 is provided with a longitudinally extending piston return pawl slot 32 which opens through the side of the barrel 8 into the barrel bore 10. A piston return pawl 34 is mounted in a pawl housing 36 threaded into the housing 4 at the muzzleward end thereof, the pawl housing 36 being closed at its outer end by a cap 38 which is threaded onto the pawl housing 36. A pawl spring 40 is seated in the pawl housing 36 and cap 38 assembly to bias the pawl 34 toward the barrel bore 10. The pawl 34 includes a reduced diameter piston-engaging portion 42 which segways into an outwardly taper shoulder 44 formed on the pawl 34. The spring 40 biases the pawl shoulder 44 into engagement with a complimentarily tapered counter bore 46 formed in the pawl return slot 32. This engagement occurs when the barrel 8 is in its breech-closed position and ensures that the barrel 8 will not accidentally slide muzzleward out of the breech-closed position as the operator handles the tool. The tapered shoulder 44 also is engaged by an end corner 48 of the pawl return slot 32 when the tool is pushed down for firing with the corner 48 causing the pawl 34 to cam down out of the barrel bore 10 temporarily while the piston is driven.

Figure 8:
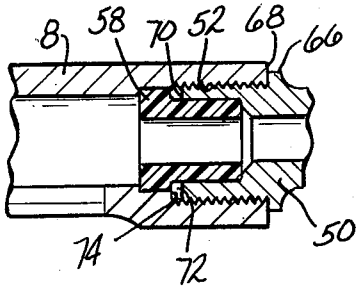
FIG. 8 is a fragmented sectional view of the muzzle end of the barrel showing the manner of attachment of the muzzle bushing to the barrel in greater detail.

A muzzle bushing 50 is threaded into a threaded bore 52 at the muzzleward end of the barrel 8. The muzzle bushing 50 has a bore 54 for receiving a fastener (not shown) to be driven into a supporting surface by the piston 12. The outer surface 56 of the muzzle bushing 50 is tapered rearwardly and inwardly to increase the difficulty of the operator grasping the outside of the muzzle busing and pulling it breechward thus depressing the barrel 8 to cock the tool for firing. This feature makes the tool more difficult to air fire. A buffer ring 58 made of polyurethane or the like is disposed in a counter bore 60 in the barrel bore 10. The buffer ring 58 is operative to absorb excess piston energy in the event of overshoot of the piston 12. The muzzleward end surface 62 of the buffer ring 58 contacts a shoulder 64 in the muzzle bushing 50 to hold the buffer ring 58 firmly in place within the tool. Referring now to FIG. 8, it will be noted that the muzzle bushing 50 is provided with an external radial flange 66 which engages the muzzleward end 68 of the barrel 8 when the muzzle bushing 50 is fully threaded into the bore 52 of the barrel 8. This enagement between flange 66 and barrel end 68 limits the extent to which the breechward end 70 of the muzzle bushing 50 will enter the barrel bore 52. In this manner, there is a free space or gap 72 between the breechward end 70 of the muzzle bushing 50 and the bottom shoulder 74 of the threaded bore 52. This gap 72 ensures that if the piston is over driven and severely impacts the buffer ring 58, there will be no resultant deformation of the threads joining the muzzle bushing 50 and the barrel 8. Thus, the muzzle bushing 50 can always be easily unscrewed from the barrel 8 despite repeated over drive of the piston.

Figure 3:
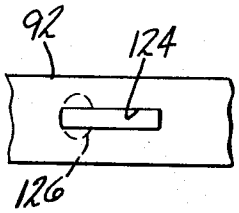
FIG. 3 is a fragmented plan view of the firing pin pawl slot formed in the breech block of the tool.

Referring back to FIG. 1, the breech end structure of the tool 2 will now be set forth. Disposed in the breech end of the housing 4 is a reciprocating breech block 76 which is biased in a muzzleward direction by a spring 78. The spring 78 seats at one end against a shoulder 80 formed on the breech block 76, and at the other end against a closure ring 82 which is threaded into the breech end of the housing 4. An extractor arm 84 is pivotally mounted on a pin 86 secured to the breech block 76, the arm 84 being biased about the pin 86 by means of an extractor spring 88. The breech block 76 is provided with a bore 90 in which is reciprocally mounted a firing pin 92. The muzzleward end of the bore 90 is provided with a passage 94 through which the tapered nose 96 of the firing pin 92 can contact the rim of the cartridge 24 chambered in the firing chamber 22 to fire the cartridge. The firing pin 92 extends through a passage 98 in the closure ring 82, which passage 98 has a counterbore 100 defining a shoulder 102. The firing pin 92 is provided with an external groove 104 in which there is fitted as removable C ring 106. The firing pin 92 also includes a spring guide 108 which projects rearwardly from the C ring 106. A firing pin spring 110 is disposed in a bore 112 in a handle member 114 so as to bear against the C ring 106 to bias the firing pin 92 muzzleward. The handle member 114 is secured to the closure ring 82 by a pair of threaded bolts (not shown) which flank either side of the counterbore 100. Th firing pin 92 is provided with a transverse blind bore 116 in which there is reciprocally slidably disposed a firing pin pawl 118. The firing pin pawl 118 is biased downwardly by a pawl spring 120 seated in the blind bore 116. The firing pin pawl 118 is provided with reduced diameter searing portion 122 which rides in a slot 124 extending longitudinally of the breech block 76. The slot 124 is provided with a profiled pawl-engaging portion 126 into which the searing portion 122 of the pawl 118 is biased when the pawl and slot portions 122 and 126 respectively are in registry. The nature of the slot 124, 126 is more clearly shown in FIG. 3. The handle member 114 also includes a blind bore 128 in which there is mounted a trigger spring 130. The trigger spring 130 engages a spring guide 132 mounted on the trigger 134, which in turn is pivotally mounted on a pin 136 set in the housing 4. The trigger 134 includes a tang or finger 138 which will engage the firing pin pawl 118 when the trigger 134 is pulled to release the firing pin pawl 18 from engagement with the pawl engaging portion 126 of the slot 124.

Figure 2:
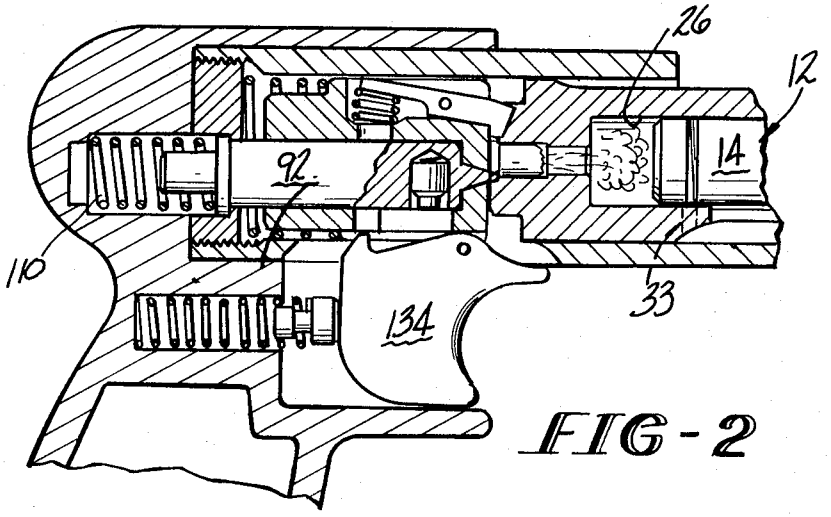
FIG. 2 is a sectional view of the breech portion of the tool of FIG. 1 showing the position of the firing pin and breech block after the tool has been fired.
Figure 7:
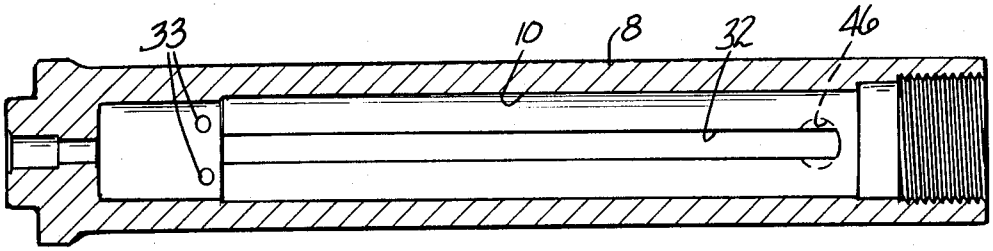
FIG. 7 is a sectional view of the barrel member of the tool looking down at the piston pawl return slot formed in the barrel.

As previously noted, the tool, as shown in FIG. 1, is in its push down, ready to fire condition, and it is held in this position by being pressed against a fastener supporting surface S, such as a wall, or the like. The tool is fired by depressing the trigger 134 to cause the trigger tang 138 to push the firing pin pawl 118 up and out of engagement with the pawl retaining portion 126 of the slot 124. When the tool is in the firing condition, the firing pin spring 110 is compressed so that release of the firing pin pawl 18 causes the spring 110 to push the firing pin 92 muzzleward to impact the rim of the chambered cartridge 24, thereby firing the cartridge 24. As shown in FIG. 2, the trigger 134 has been pulled, and the firing pin 92 has been pushed by the firing pin spring 110 to its firing position. Thus, the position of the firing pin 92 as shown in FIG. 1 is the cocked position, and as shown in FIG. 2 is the fired position. Firing of the cartridge 24 generates high pressure combustion gases which pass through the gas passage 28 into the gas expansion portion 26 of the barrel bore 10. The piston 12 is thus propelled muzzleward through the barrel bore 10 to drive the fastener into the supporting surface. As the piston head 14 leaves the gas expansion portion 26 of the barrel bore 10, the combustion gases are vented from the barrel bore 10 via the piston return pawl slot 32. A pair of auxiliary gas vents 33 are also provided to increase gas venting (see FIG. 7).

Figure 4:
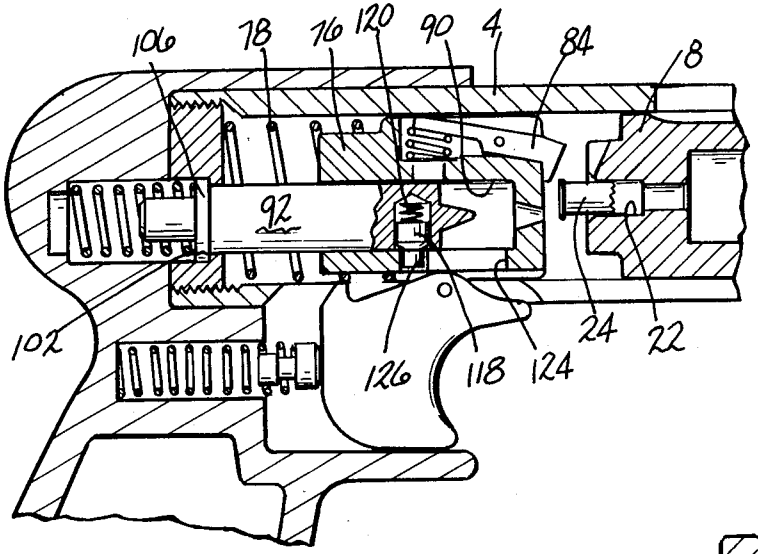
FIG. 4 is a sectional view of the breech portion of the tool as the latter appears during opening of the breech to extract a fired cartridge.

After the fastener has been driven into the supporting surface, the tool is withdrawn from contact therewith and the barrel 8 is pulled muzzleward with respect to the housing 4. This muzzleward movement of the barrel 8 causes the spent cartridge 24 to be extracted and ejected from the firing chamber 22 by means of the extractor arm 84, as shown in FIG. 4. As also shown in FIG. 4, once the barrel 8 is pulled forward, the breech block 76 will move forward in the housing 4 under the influence of the breech block spring 78. At the same time, the firing pin 92 will retain its position in the breech block bore 90 due to the fact that the C ring 106 is in engagement with the closure ring shoulder 102. Thus, the breech block 76 also slides muzzleward over the firing pin 92. This muzzleward movement of the breech block 76 stops when the firing pin pawl 118 is again in registry with the pawl retaining portion 126 of the breech block slot 124, whereupon the pawl spring 120 will push the searing portion 122 of the firing pin pawl 118 down into engagement with the pawl retaining portion 126 of the breech block slot 124. Thus, the firing pin 92 is automatically returned to its cocked position within the breech block 76. As previously described, complete forward movement of the barrel 8 will cause the piston return pawl 34 to engage the forward surface 18 of the piston head 14 and thus cause the piston 12 to slide breechward in the barrel bore 10 thereby returning the piston 12 to its driving position.

Figure 6:
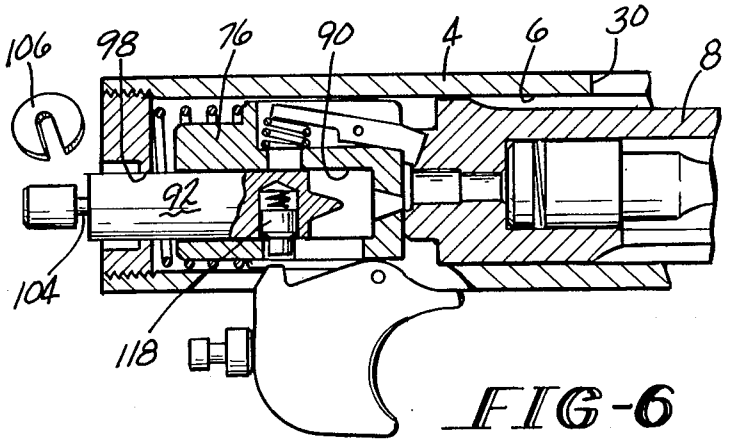
FIG. 6 is a sectional view similar to FIG. 5 but showing the manner in which the firing pin C ring is removed to allow further disassembly of the breech mechanism.
Figure 5:
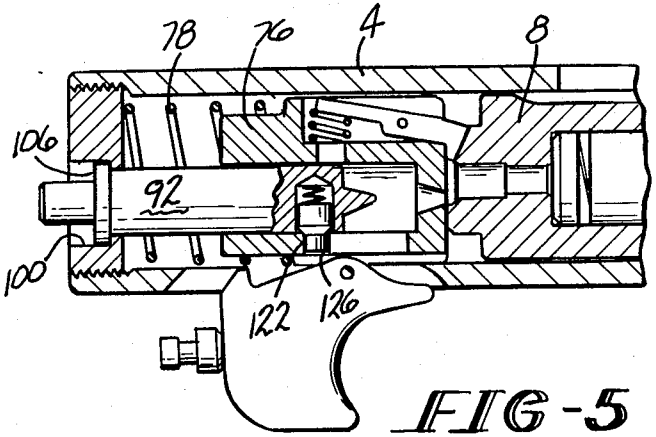
FIG. 5 is a sectional view of the breech portion of the tool as it appears after the handle of the tool has been removed to begin disassembly of the tool.

Referring now to FIGS. 5 and 6, the manner in which the breech assembly of the tool is disassembled is shown. First the handle member is removed from the closure ring by unscrewint the bolts previously mentioned. This will result in the partial tool structue shown in FIG. 5. The barrel 8 is then pushed breechward so that the breech block 76 will move breechward and compress the breech block spring 78. The interlock of the firing pin pawl searing portion 122 with the breech block slot portion 126 will also cause the firing pin 92 to move breechward within the housing 4. This breechward movement is continued until the C ring 106 is moved out of the closure ring counterbore 100 whereupon the C ring 106 can be manually grasped and removed from the firing pin groove 104, as shown in FIG. 6. Once the C ring 106 has been removed from the firing pin 92, the entire breech mechanism can be slid in a muzzleward direction through the housing bore 6. To accomplish this muzzleward movement of the breech mechanism, the barrel 8 is first moved muzzleward in the housing bore 6 and the breech mechanism is moved muzzleward behind the barrel 8. Once the breech mechanism reaches the housing opening 30, the breech mechanism can be lifted out of the housing 4 through the opening 30. To remove the firing pin 92 from the breech block 76, the firing pin pawl 118 is depressed with a pointed tool and the firing pin 92 is pulled out of the breech block bore 90.

It will be readily appreciated that the tool of this invention includes a number of desirable features which are provided with a minimum of complexity. The barrel detent, for example, is provided with a minor modification of existing tool structure. The searing of the firing pin in its cocked position is accomplished also with a minor modification of the tool structure. Disassembly of the breech mechanism is simple to accomplish due to the simplified construction thereof. Difficulty of air firing of the tool is increased by a relatively simple modification of the muzzle bushing.

Since many changes and variations of the disclosed embodiment of the invention may be made without departing from the inventive concept, it is not intended to limit the invention otherwise than as required by the appended claims.

What is claimed is:

1. A powder-actuated fastener driving tool comprising:

(a) a housing having a bore;

(b) a barrel reciprocally slidably mounted in said housing bore, said barrel having a bore;

(c) a fastener driving piston reciprocally slidably mounted in said barrel bore;

(d) said barrel having an internally threaded bore at the muzzleward end portion of said barrel;

(e) a muzzle bushing threaded into said threaded bore of said barrel, said muzzle bushing having an external circumferential flange disposed in abutting contact with the muzzleward end surface of said barrel to limit the extent to which said muzzle bushing enters said threaded bore, whereby the breechward end of said threaded bore and the breechward end of said muzzle bushing remain in spaced apart relationship sufficient to protect the mating threads on said muzzle bushing and threaded bore from deformation which would otherwise occur in the event of piston overdrive; and (f) said muzzle bushing including a bore having an enlarged counter-bore at the breechward end of said muzzle bushing and further comprising an annular buffer member mounted in the muzzleward end of said barrel bore and extending into said muzzle bushing counter-bore.

* * * * *